US009679435B2

(12) United States Patent
Schrementi et al.

(10) Patent No.: US 9,679,435 B2
(45) Date of Patent: Jun. 13, 2017

(54) GAMING MACHINE MOUNTING APPARATUS AND SYSTEM FOR SUPPORTING AN OVERHEAD DISPLAY

(71) Applicant: Incredible Technologies, Inc., Vernon Hills, IL (US)

(72) Inventors: Daniel J. Schrementi, Lombard, IL (US); Matthew Randazzo, Itasca, IL (US)

(73) Assignee: Incredible Technologies, Inc., Vernon Hills, IL (US)

( * ) Notice: Subject to any disclaimer, the term of this patent is extended or adjusted under 35 U.S.C. 154(b) by 187 days.

(21) Appl. No.: 14/276,618

(22) Filed: May 13, 2014

(65) Prior Publication Data

US 2014/0342825 A1 Nov. 20, 2014

Related U.S. Application Data

(60) Provisional application No. 61/823,746, filed on May 15, 2013.

(51) Int. Cl.
*G07F 17/32* (2006.01)

(52) U.S. Cl.
CPC ..... *G07F 17/3216* (2013.01)

(58) Field of Classification Search
CPC ..... G07F 17/3216; A63F 13/08; B23P 11/00
USPC ..... 273/366, 367, 368, 369, 370
See application file for complete search history.

(56) References Cited

U.S. PATENT DOCUMENTS

| | | | | |
|---|---|---|---|---|
| 5,292,127 | A * | 3/1994 | Kelly | A63F 7/0058 273/118 A |
| 6,585,201 | B1 * | 7/2003 | Reed | B60R 11/0235 248/181.1 |
| 7,178,775 | B2 * | 2/2007 | Pfister | F16C 11/103 248/292.14 |
| 7,395,996 | B2 * | 7/2008 | Dittmer | F16M 11/10 248/291.1 |
| 8,303,402 | B2 * | 11/2012 | Aoki | G07F 17/3213 463/16 |
| 9,240,097 | B2 * | 1/2016 | Cornell | G07F 17/3216 |
| 9,307,669 | B1 * | 4/2016 | Briggs | A47B 57/16 |
| 2006/0199647 | A1 * | 9/2006 | Anderson | A63F 13/08 463/46 |
| 2006/0277805 | A1 * | 12/2006 | Kopera | G07F 17/32 40/584 |
| 2007/0041213 | A1 * | 2/2007 | Short | F16M 11/02 362/561 |
| 2008/0123265 | A1 * | 5/2008 | Ohlinger | F16M 11/24 361/679.06 |

(Continued)

*Primary Examiner* — Kang Hu
*Assistant Examiner* — Malina D Blaise
(74) *Attorney, Agent, or Firm* — Husch Blackwell LLP; George S. Pavlik

(57) ABSTRACT

A system and apparatus for mounting an overhead display device to gaming machines. The system and apparatus featuring mounting elements securable to a display device at a selected distance and mounting hardpoints on one or a plurality of gaming machines. The hardpoints having a recess with a size and shape corresponding to that of the mounting elements. Wherein the display is securable to gaming machines in an overhead configuration when the mounting elements are secured to hardpoints and where the distance between the mounting elements corresponds to the distance between the hardpoints to which they are respectively secured.

18 Claims, 10 Drawing Sheets

(56) References Cited

U.S. PATENT DOCUMENTS

| | | | | |
|---|---|---|---|---|
| 2009/0050763 | A1* | 2/2009 | Dittmer | F16M 11/10 248/284.1 |
| 2009/0124395 | A1* | 5/2009 | O'Keene | G07F 17/3216 463/46 |
| 2009/0253499 | A1* | 10/2009 | Nagano | G07F 17/3216 463/30 |
| 2009/0253500 | A1* | 10/2009 | Nagano | G07F 17/3216 463/30 |
| 2009/0253514 | A1* | 10/2009 | Nagano | G07F 17/3211 463/42 |
| 2010/0059640 | A1* | 3/2010 | Helgesen | A47B 81/062 248/205.1 |
| 2011/0009189 | A1* | 1/2011 | Jordan | G07F 17/3202 463/30 |
| 2011/0025943 | A1* | 2/2011 | Cho | G02F 1/133308 349/58 |
| 2011/0207530 | A1* | 8/2011 | Chudek | G07F 17/3218 463/30 |
| 2011/0275443 | A1* | 11/2011 | Cole | G07F 17/3216 463/46 |
| 2012/0175321 | A1* | 7/2012 | Ditges | F16M 11/24 211/26 |
| 2012/0208645 | A1* | 8/2012 | Rodriguez | G07F 17/3211 463/46 |
| 2012/0220363 | A1* | 8/2012 | Bytnar | G07F 17/3213 463/25 |
| 2013/0082156 | A1* | 4/2013 | Conner | F16M 11/08 248/281.11 |
| 2013/0157751 | A1* | 6/2013 | Loose | G07F 17/3211 463/25 |
| 2015/0276356 | A1* | 10/2015 | Cesternino | F41J 9/02 273/370 |
| 2016/0312952 | A1* | 10/2016 | Kalis | F16M 13/022 |

* cited by examiner

GAMING MACHINE MOUNTING APPARATUS AND SYSTEM FOR SUPPORTING AN OVERHEAD DISPLAY

CROSS REFERENCE TO RELATED APPLICATION

This application claims the benefit of U.S. Provisional Patent Application Ser. No. 61/823,746 filed May 15, 2013, the entirety of which is hereby incorporated by reference as if fully set forth herein.

FIELD

The subject invention pertains to overhead gaming machine displays and more particularly to a gaming machine and mounting apparatus for securing overhead displays to gaming machines in a plurality predetermined configurations.

BACKGROUND

Mechanical and electronic gaming machines are generally well known and have been relatively popular, and profitable, for a number of years. Such machines can be configured to provide a variety of casino or entertainment games, including for example, mechanical or electromechanical slot-type matching games, video games or electronic casino games, such as video poker, blackjack, keno, roulette, etc. Such gaming machines typically have an exterior cabinet or housing enclosing the game's mechanical or electronic components, a user input device or control panel, and one or more displays or arrays for visually presenting the game to a player.

Typically, such gaming machines are arranged at gaming establishments in clusters or banks consisting of at least two machines that are physically located adjacent or in close proximity to one another. Usually, gaming machines in a bank will be the same, size style or type (e.g., upright, slant-top, table-top), be made by the same manufacturer, and/or offer identical or related games having a common themes, characters or methods of play.

Commonly, clusters or banks of gaming machines occasionally can include separate electronic or luminescent displays, lights, or signs that can be affixed to the housing of one or more of the machines or to some other nearby structure. For example, displays can be suspended from the ceiling or wall, mounted on free-standing stands, or otherwise inserted into the environment in an environmentally-dependent and non-standardized way. Such displays can include, for example, electroluminescent "bank signs" or video monitors that can present static graphics, electronic images or dynamic video for purposes of promoting or drawing attention to the game(s) or the gaming establishment. Typically, such displays are positioned above the gaming machines so that they can be easily seen at a distance across a gaming establishment. Such displays can be mechanically and/or electrically coupled to one or more machines or be independently powered.

Typically, operators of gaming establishments will periodically rearrange, substitute or replace gaming machines within a bank or relocate machines to different locations within a gaming venue. Where an overhead display is used in connection with such games, usually the display has to either be taken down, repositioned or otherwise repurposed for an alternative use. In addition, where the operator wishes to transfer the display for continued use with relocated machines, the display generally has to be remounted to a different structure or machine in the new location. Such undertakings can be extremely time consuming and labor intensive.

Thus, in view of the foregoing, it would be useful for a gaming machine, or mounting device affixed to a gaming machine, to be able to securely support a display apparatus directly onto a gaming machine. It would be further useful for such machine or device to provide configurations allowing for standardized mounting arrangements for such a display apparatus, which would in turn allow the operators of casinos or gaming venues to standardize their signage and other display means. It would also be useful to use the cabinets of the gaming machines themselves—which are typically very well made and of high quality—to be incorporated as part of the mounting system to allow the mechanical strength of the cabinets to become part of the mounting system. It will be recognized by persons of ordinary skill in the art that such mounting devices, structures and systems can improve the operation and productivity of the gaming venue as well as having certain aesthetic benefits.

DETAILED DESCRIPTION

Figure 1:
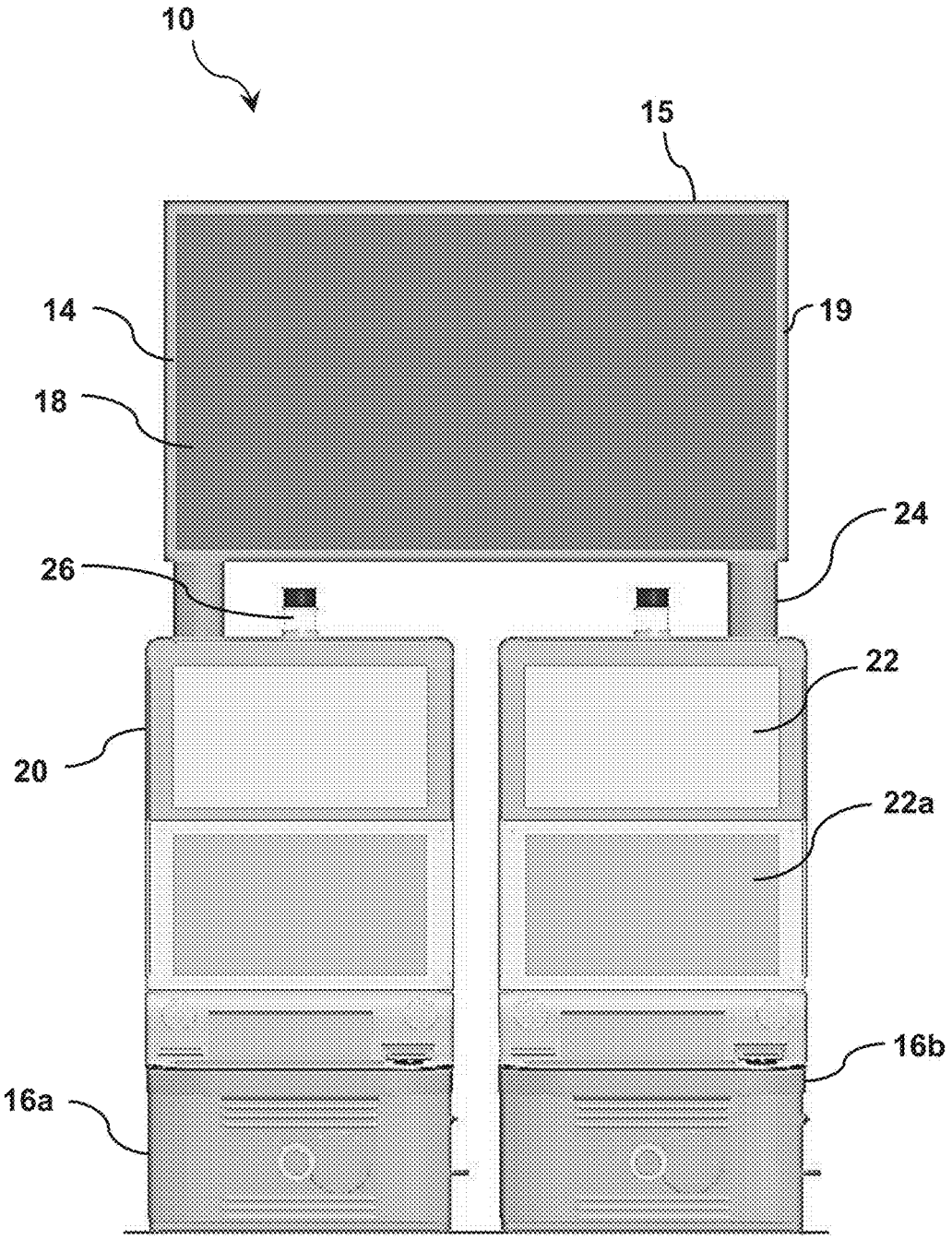
FIG. 1 is a front elevational view of two gaming machines arranged side-by-side with a single overhead display mounted thereto in accordance with embodiments presented herewith.
Figure 1A:
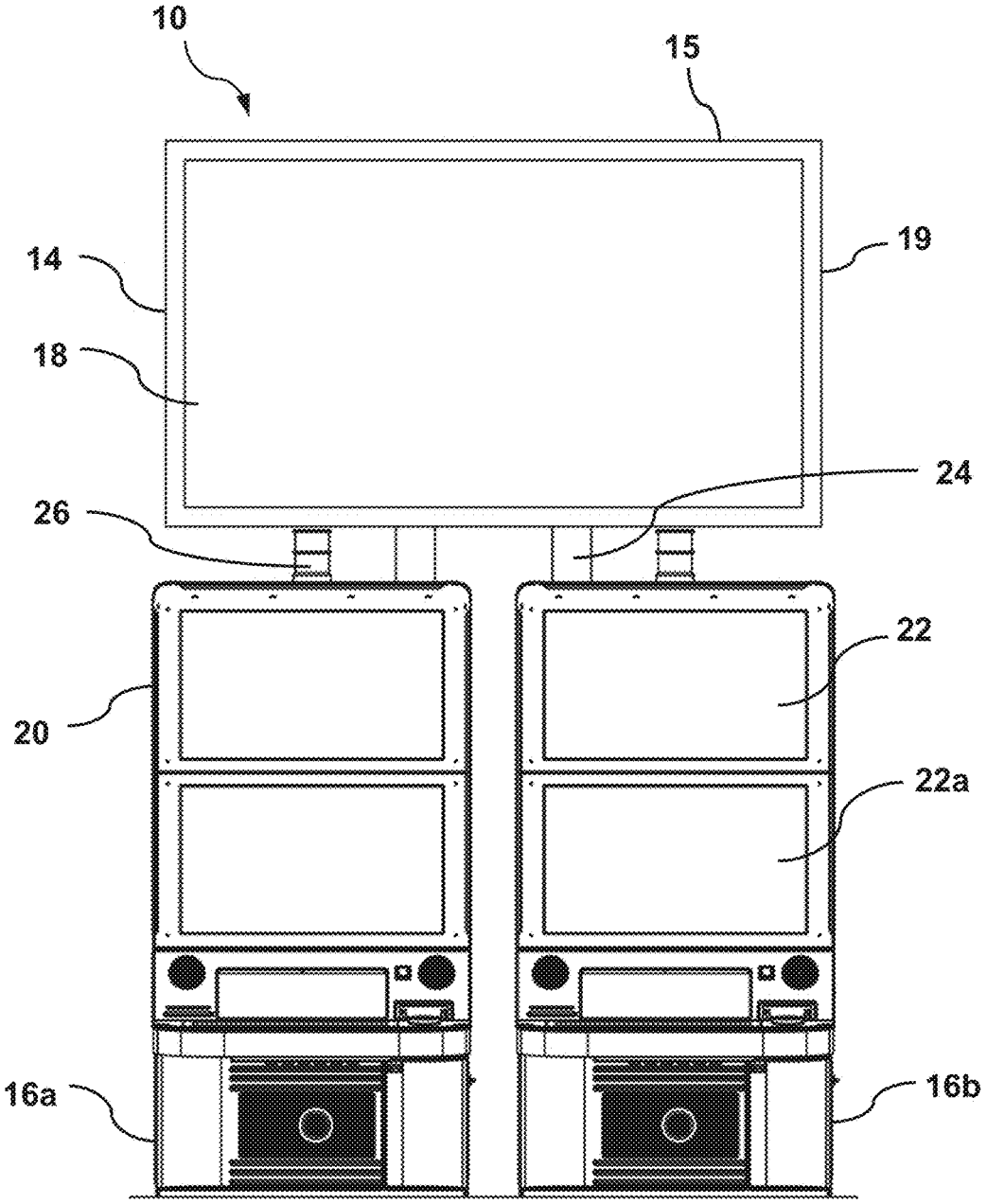
FIG. 1A is a front elevational view of two gaming machines arranged side-by-side with a single overhead display mounted thereto in accordance with embodiments presented herein.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

As presented herein, embodiments of the subject invention are directed to gaming machines and mounting apparatuses for securing an overhead display device to a gaming machine. The mounting apparatus can be part of an original prefabricated gaming machine unit or a separate aftermarket unit that can be sold together with a gaming machine or sold separately as an aftermarket accessory that can be installed on gaming machines already in use. The mounting apparatus can generally include one or more mounting hardpoints for receiving and/or securing a portion of a bracket, support or frame for supporting a display device. The hardpoints can include pre-drilled holes, channels or grooves, or outwardly extending connectors and/or other fastening devices such as adaptors, clamps or other receivers having sockets or adjustable collars for receiving a support of the display device.

According to embodiments disclosed herein, the mounting apparatus can be used on one or multiple gaming machines to accommodate one or more displays which are significantly larger than a single machine. As disclosed further herein, the mounting apparatus can be positioned geometrically on the gaming machines in certain standard mounting configurations providing certain predetermined dimensions that can easily accommodate the mounting of display apparatus of a standard size, or multiple different standard-sized displays if required. Embodiments presented herein can further accommodate the mounting of a plurality of mounting apparatuses which can allow an operator to be able to select between a plurality of different mounting configurations when arranging the gaming machines and display apparatus. Subject embodiments can additionally provide for adjustable hardpoints which can provide some reasonable level of adjustment to allow for slight variation in the geometric placement of the gaming machines in relation to each other.

Where the gaming machines are electrical and connected to a power supply, embodiments presented herein can additionally provide means to either supply power (if required) to the display apparatus, and/or means to communicate information for display. In heavily regulated environments, it can be preferred, but not required, that the display apparatus not communicate or otherwise interface with the gaming machine other than from a pure mechanical support standpoint, as that would cause it to be considered "part" of the machine which would be subject to regulation. However, if it is desired to accept the consequences of such regulation (expense, time, approval, and other limitations), the display apparatus can be electrically coupled to communicate with an electronic gaming machine. Where the display is not in communication with the gaming machine, it can function as a standard commercial display apparatus (signs, commercially produced video displays, etc.) and can be used and modified at the discretion of the operator without the accompanying regulatory oversight which would otherwise be required.

In an alternate embodiment, the display apparatus can include a frame or other mounting or receiving means which could be used to hang signs or other display elements of a non-standard size or shape. It will be recognized that this configuration allows greater flexibility in operation while still allowing the aesthetic and mechanical advantages of the mounting hardpoints and their optimized geometric placements.

With reference now to the figures, FIGS. 1-3 and 6-8 illustrate configurations 10, 11, 12 for mounting overhead display(s) 14 to a plurality of gaming machines 16. As can be seen, the display devices 14 can be secured overhead/above the machines 16 in an upright position such that the screen or array 18 is oriented substantially perpendicular to the floor or surface upon which the gaming machines 16 are positioned. In this position, the screen or array 18 of the display device 14 can project imagery displayed thereon above the gaming machines 16 in a substantially horizontally direction such that such imagery can be readily seen across a vast or bustling gaming venue. Alternatively, the display 14 can be mounted at a slight angle relative such perpendicular orientation, such that the screen or array 18 is tilted slightly upward or downward (on the order of +/−30 degrees from a vertical axis) as may be required to improve visibility of the screen or array 28 depending on the specific conditions or location where the machine is located.

Figure 2:
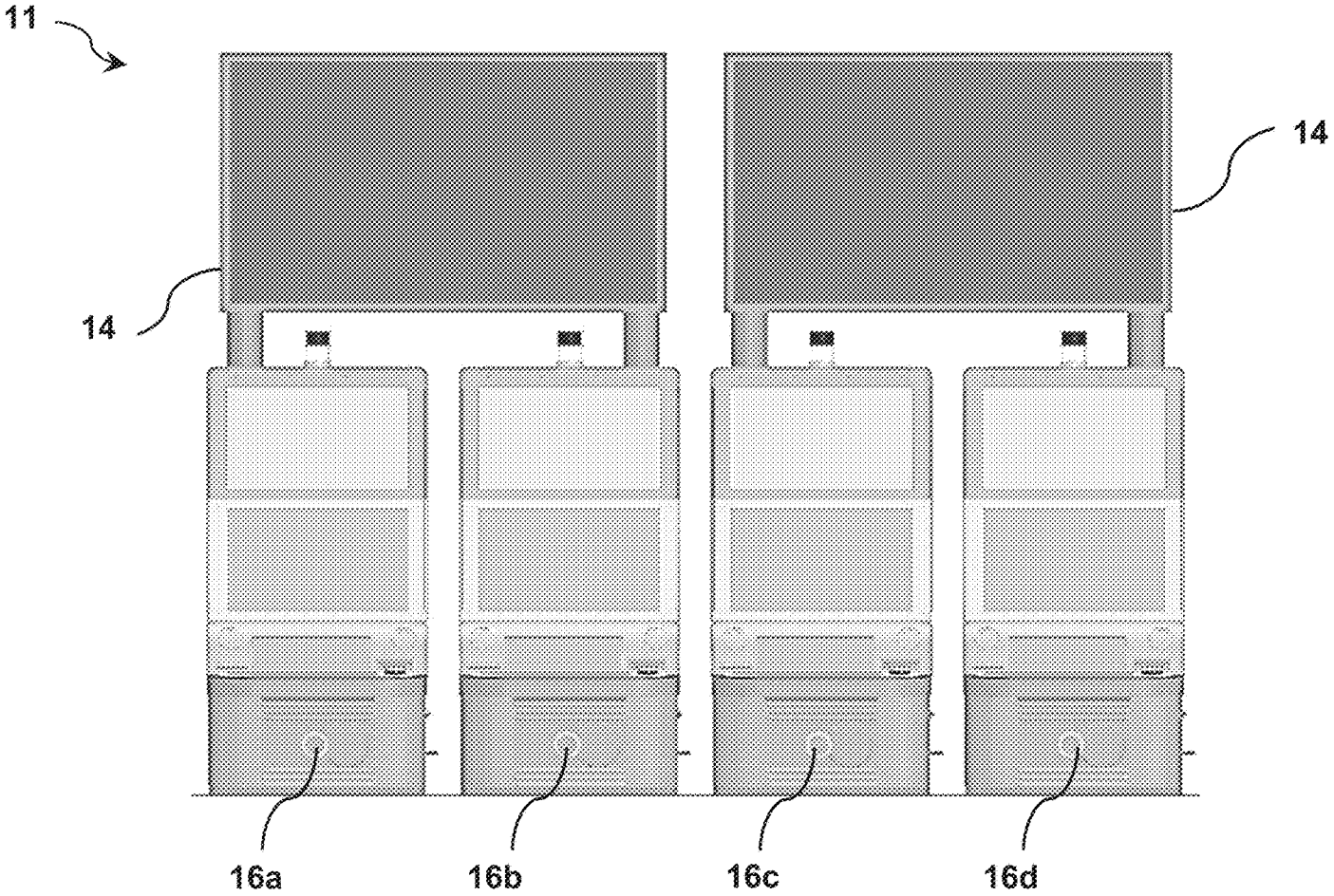
FIG. 2 is a front elevational view of two pairs of gaming machines arranged side-by-side with a pair of overhead displays mounted thereto in accordance with embodiments presented herein.
Figure 2A:
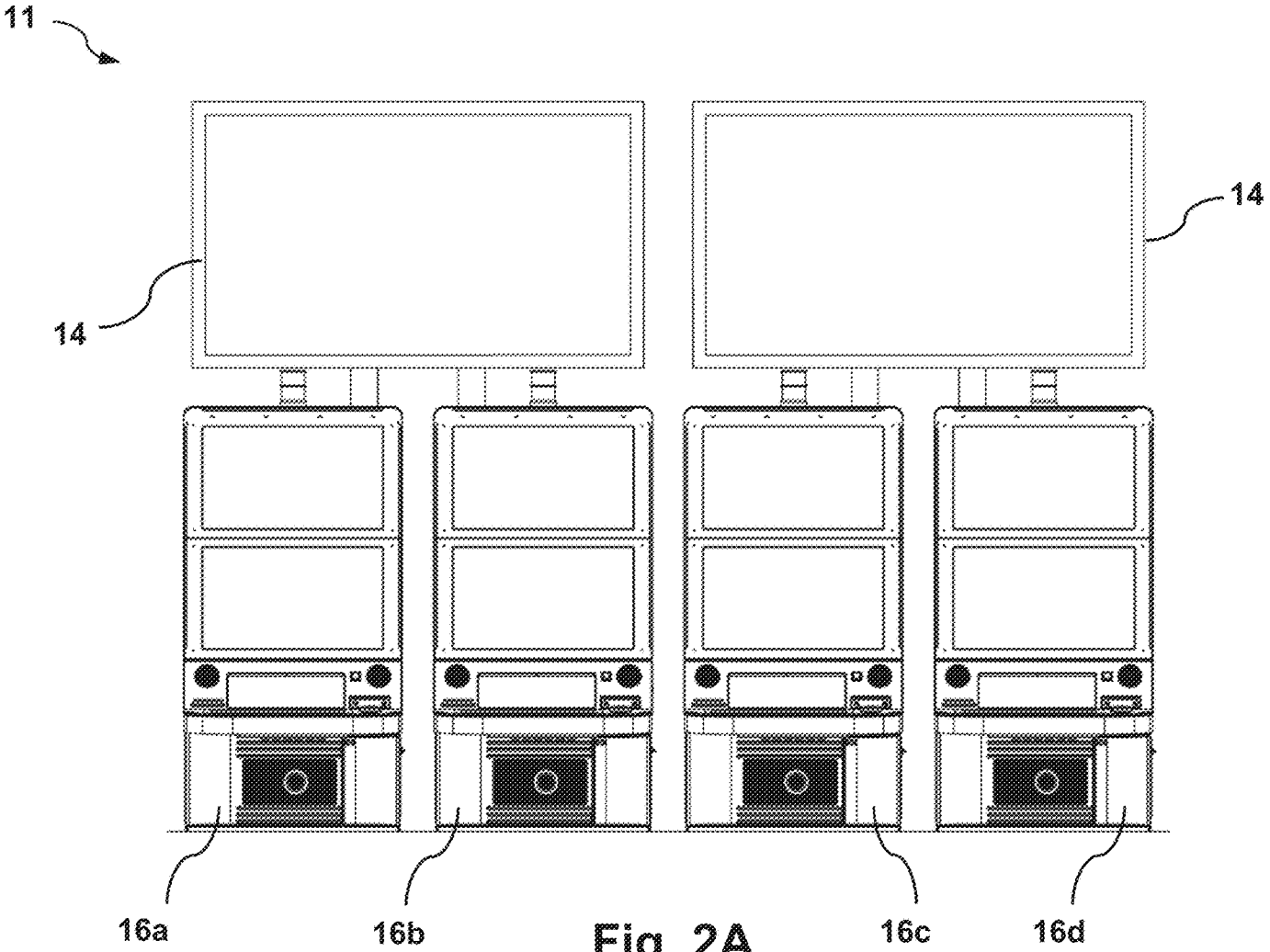
FIG. 2A is a front elevational view of two pairs of gaming machines arranged side-by-side with a pair of overhead displays mounted thereto in accordance with embodiments presented herein.
Figure 2B:
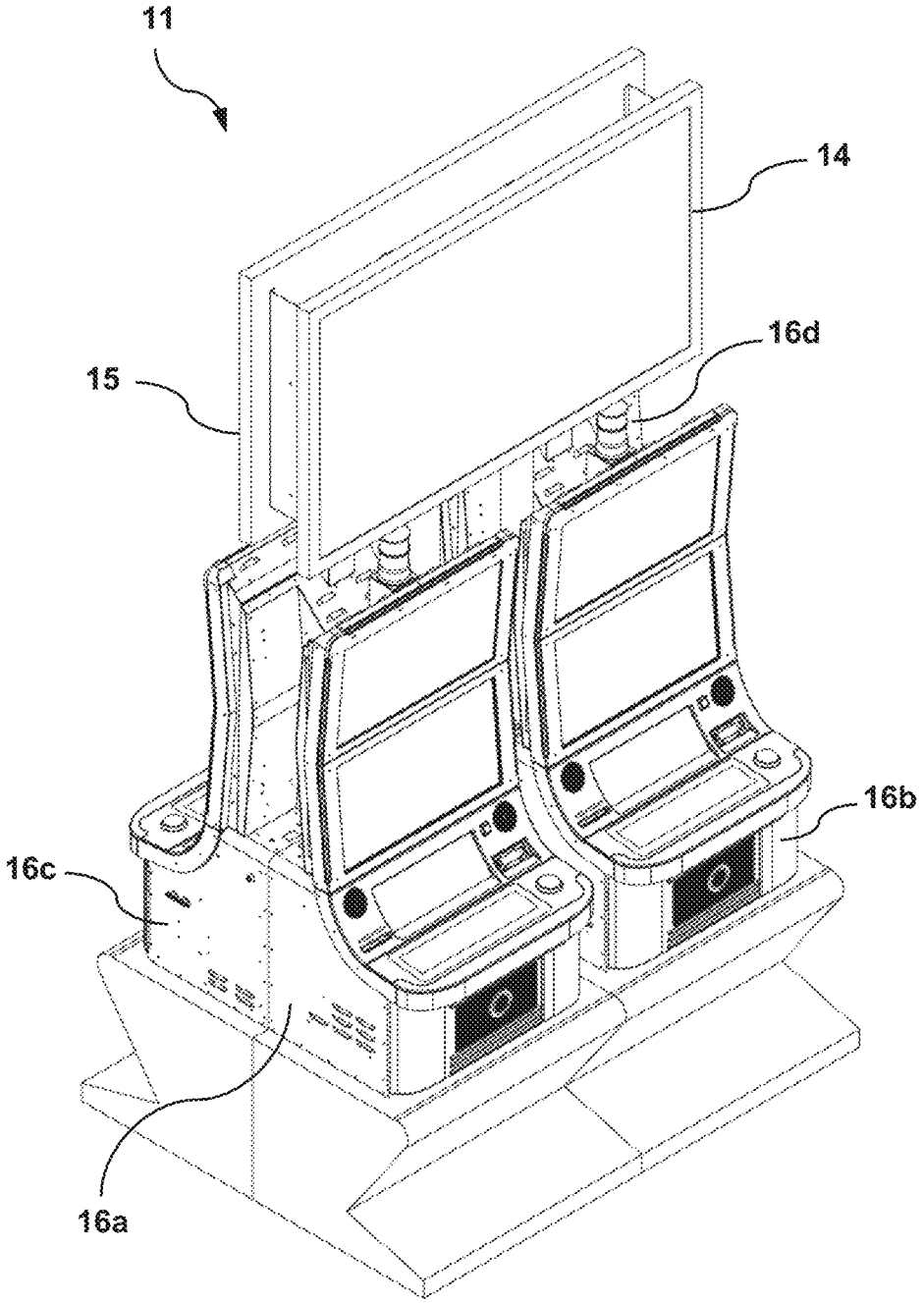
FIG. 2B is a perspective view of two pairs of gaming machines arranged back-to-back with a pair of overhead displays mounted thereto in accordance with embodiments presented herein.
Figure 3:
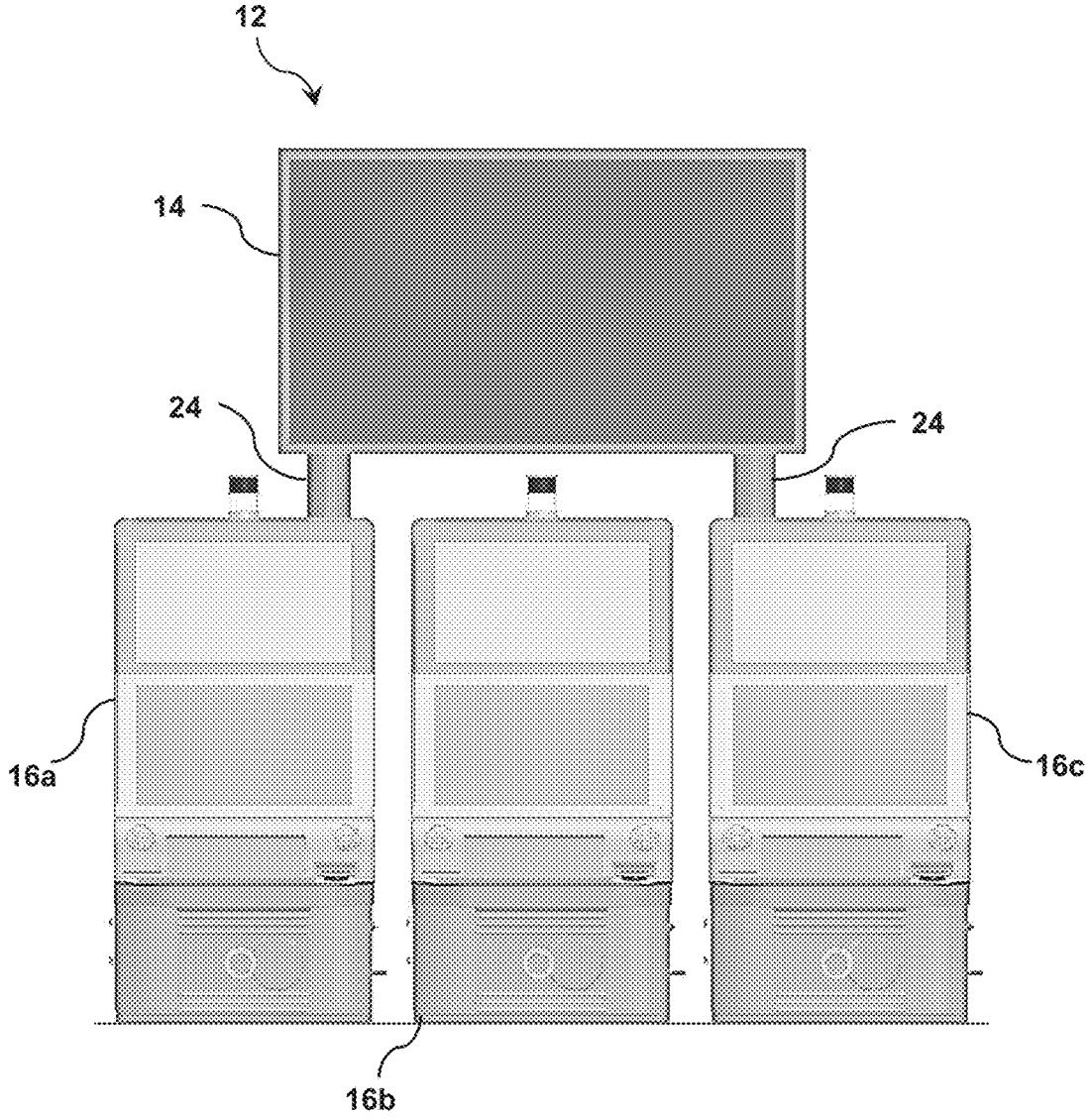
FIG. 3 is a front elevational view of three gaming machines arranged side-by-side with a single overhead display mounted thereto in accordance with embodiments presented herewith.
Figure 3A:
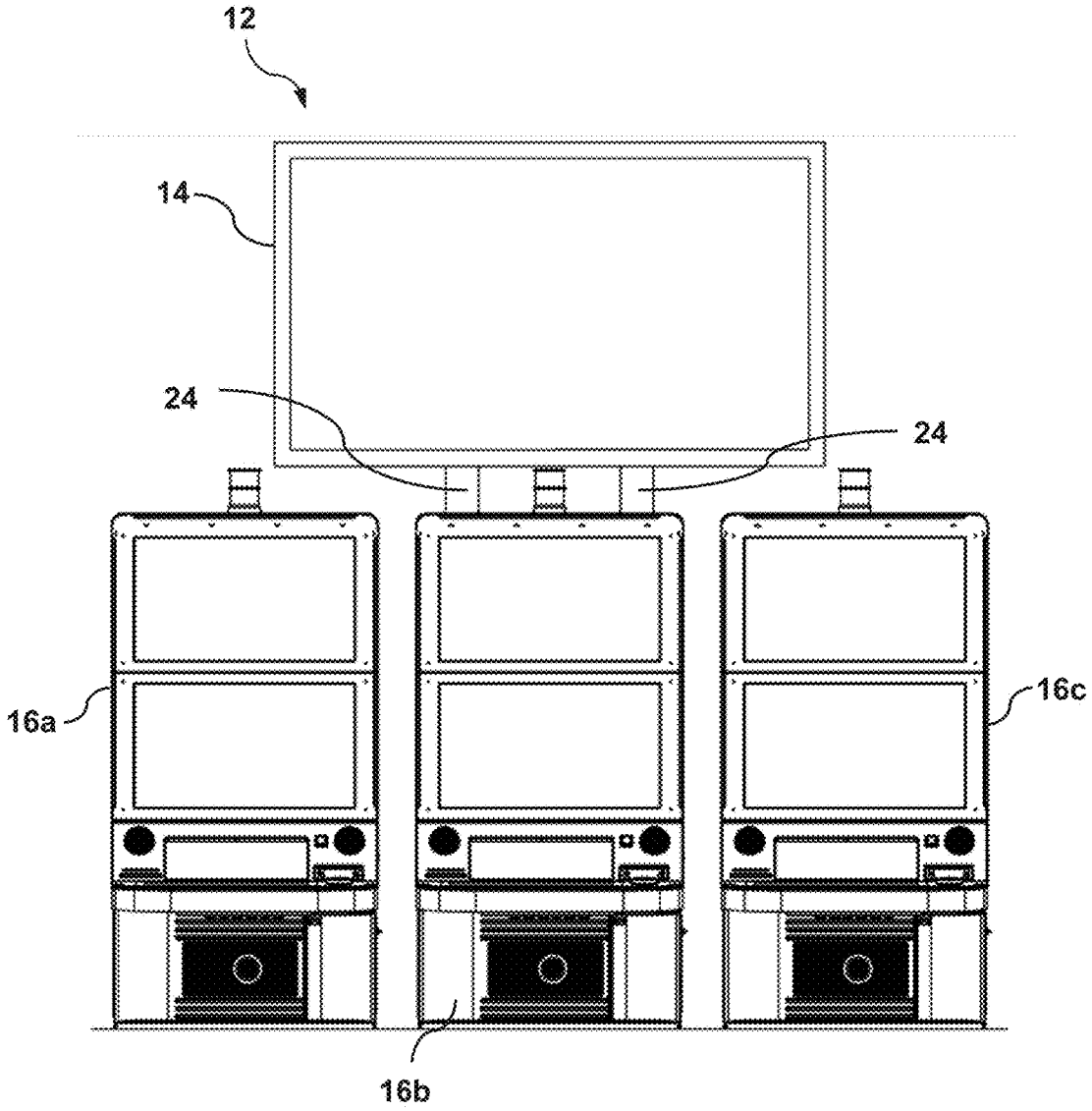
FIG. 3A is a front elevational view of three gaming machines arranged side-by-side with a single overhead display mounted thereto in accordance with embodiments presented herein.
Figure 8:
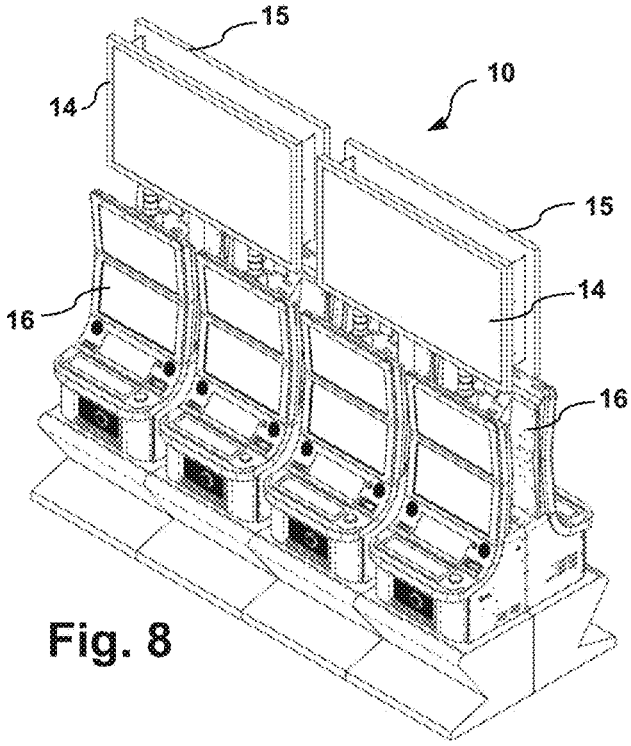
FIG. 8 is a perspective view of an arrangement of eight gaming machines arranged in two back-to-back rows with four overhead displays mounted thereto in accordance with embodiments presented herein.

As illustrated in FIGS. 1-3 and 6-8, the configurations 10, 11, 12 can include one or more display(s) 14 each having a single forward-facing array 18*a* that projects imagery in a direction in a substantially outward direction in front of the machine(s) 16. Embodiments of the subject invention, however, can also feature multiple displays or arrays having different orientations. For example, as illustrated in FIGS. 2B and 8 such embodiments can include two back-to-back displays having a first display 14 as shown in FIGS. 1-3 and a second display 15 located behind display 14 and projecting imagery in an opposite direction. In addition, embodiments presented herein can have a single display 14 with multiple arrays including, for instance, a first array 18 facing a first direction and a second array 19 located behind the first array 18 and projecting imagery in an opposite direction. Embodiments of the subject invention can further have multiple other displays or arrays oriented in other directions as well (including for example side, angled, top and/or bottom facing displays or arrays as desired).

The display(s) 14 can be any kind of device for presenting visual imagery, including for example, a fixed sign or poster, a roll-sign, split-flap display, electronic segment displays, an electrically backlit static display or an electronic display that can present static electronic images or dynamic video images. Such displays 14 can be used for presenting an infinite variety of information, including without limitation, advertisements, logos or other representations directed to the games, the gaming venue or the manufacturer of the gaming machines, video, graphics, statistics or other data regarding winning outcomes or progressive jackpots, marketing of third party businesses or entities, or information regarding the status of games being played on the machines 16, including the duration of play, recent outcomes or wagers, available/remaining credits or rankings of tournament or group play. Where the displays 14 are electronic, they can be any kind of device or type, including for example, LCD, plasma, LED, CRT, or rear-projection without limitation.

Persons of ordinary skill in the art will understand that embodiments presented herein can incorporate or accommodate any size display 14.

As shown in FIGS. 1-3 and 6-8, the gaming machines 16 can feature an exterior cabinet or housing 20 enclosing the machines internal mechanical or electronic components and one or more displays or arrays 22*a*, 22*b* for visually presenting the game or gaming information to a player. As described further herein, the gaming machine displays 22*a*, 22*b* can include a display area presenting mechanical reels or other components of the game, a fixed sign or backlit static display presenting gaming information such as for example odds, a pay table, logos or other designations of the game, or an electronic display that can present graphics or dynamic images visually representative of the gaming elements, the progression of play and outcome of the games.

The display device(s) 14 can be secured to top of the exterior cabinet 20 of a gaming machine 16 or to some other structure, such as one of the machine's displays 22*a*, 22*b*, as may be required. As illustrated in FIGS. 1-3 and 6-8, the display(s) 14 are mounted to the machines 16 by two cylindrical elongated mounting columns or elements 24. These mounting elements 24 can be part of a mounting bracket or frame affixed to the rear or bottom of the display(s) 14 or can be separate devices that are separately coupled to the display(s) 14 at different locations. The mounting elements 14 can have a length that is sufficient to extend the display(s) 14 above the machines 16 at a sufficient distance in order to clear any of components 26 such as for example, sirens, audio transducers, game toppers, lights or other indicators that may also be mounted to the top of the machine. Thus, the mounting elements 24 can be provided in standard or varying customizable lengths as need be, or can additionally be adjustable in length in order to accommodate different types of machines 16.

It will be understood that although FIGS. 1-3 and 6-8, illustrate the display(s) 14 each being supported by two cylindrical mounting elements 24 which are slightly inwardly offset from the outer edges of the display(s) 14, persons of ordinary skill in the art will recognize that more or less mounting elements 14 can be used, that the mounting elements 24 can have alternative shapes or sizes, and/or be coupled to the display(s) 14 at different locations or positions. The distance between the mounting elements 24 can additionally be uniform for displays 14 of a particular size or can be variable. Moreover, although FIGS. 1-3 and 6-8 illustrate the display device(s) 14 being secured to the top of the gaming machines 16, it will be understood that they can also be mounted to other locations or structures of a machine 16 without departing from the novel scope of the subject invention. For example, where overhead positioning is desired, but the configuration of the top surface of the machine 16 is not conducive for securing the mounting elements 24, an angled mounting element 24 can be used to secure the display 14 to the sides of the cabinet 20. It will be further understood that although FIGS. 1, 1A, 2, 2A, 3, 3A and 6 illustrate display(s) 14 secured to a plurality of gaming machines in a side-by-side arrangement, according to embodiments presented herein, the display(s) can be secured to a single gaming machine (see e.g. FIGS. 3A and 6) or gaming machines positioned in alternate arrangements (including circular, back-to-back, staggered, etc.) (see e.g. FIGS. 2B, 7 and 8).

Figure 4A:
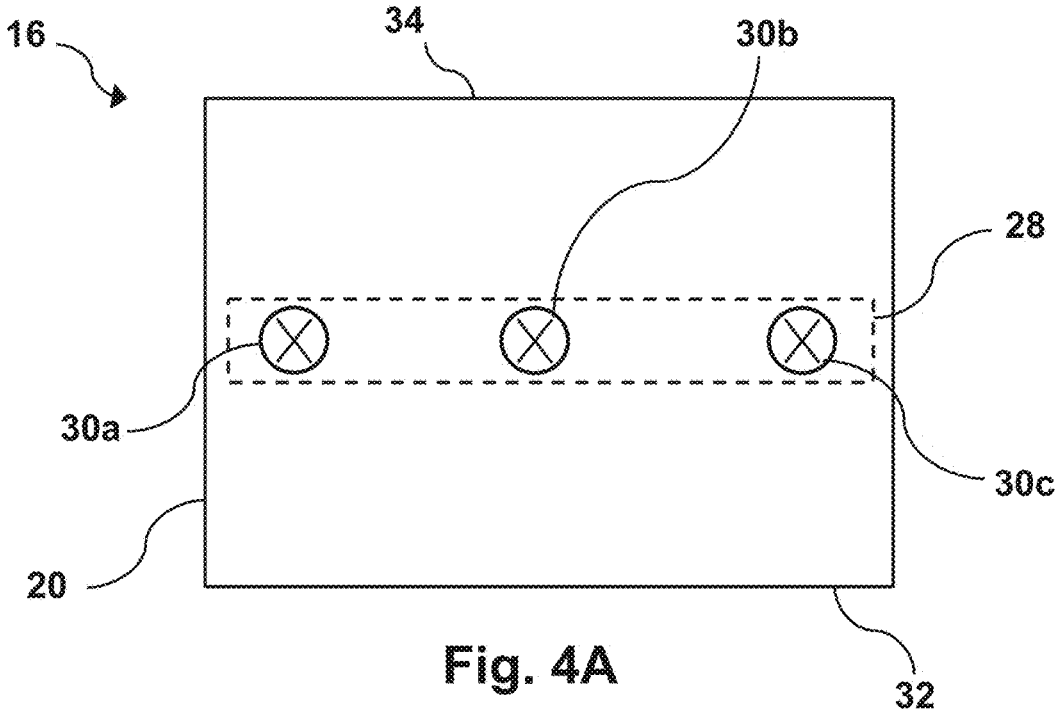
FIG. 4A is a top plan view of a sample mounting arrangement in accordance herewith.
Figure 4B:
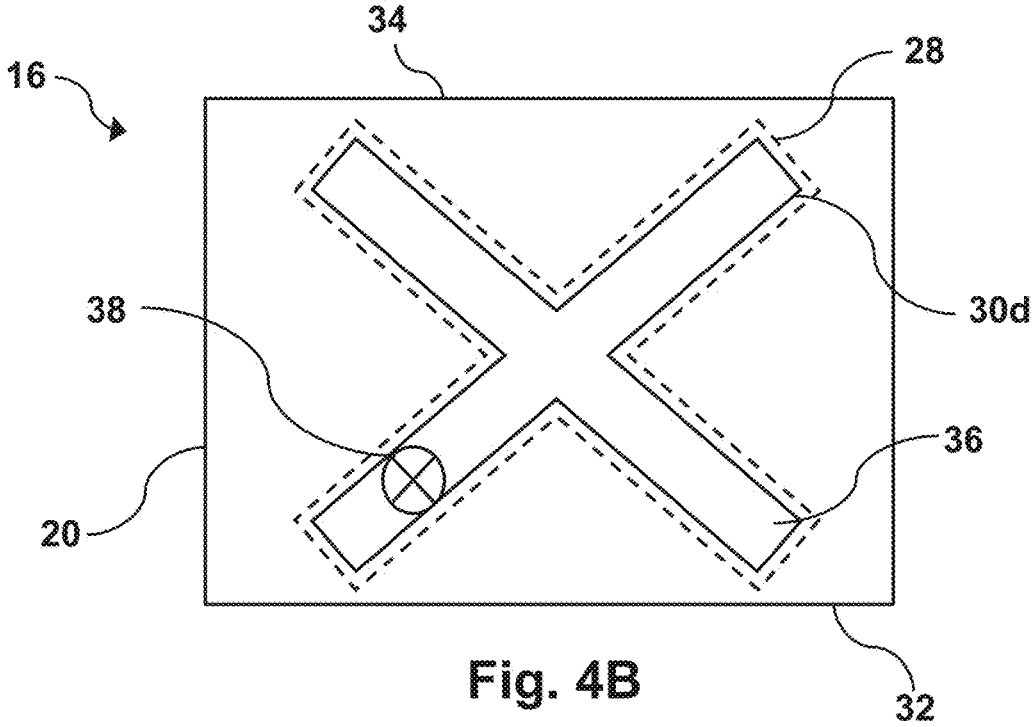
FIG. 4B is a top plan view of an alternative sample mounting arrangement in accordance herewith.

FIGS. 4A and 4B are top plan views illustrating sample mounting configurations that can be provided on the top of a gaming machine 16. These configurations can be provided directly on the top of the exterior cabinet 20 of a machine 16, or can be provided on one or more separate mounting apparatuses or adaptor plates 28 that can be affixed to the exterior cabinet 20 of the machine. As illustrated in FIG. 4A, the mounting configuration features three discrete mounting hardpoints 30*a*, 30*b*, 30*c* aligned across the width of the machine 16. The hardpoints 30*a*, 30*b*, 30*c* can be predrilled holes of a predetermined shape, size and/or depth to accommodate a portion of a correspondingly sized and shaped mounting element 24. Alternatively, the hardpoints 30*a*, 30*b*, 30*c* can be outwardly extending connectors that that can be affixed to the top of the machine 16 and can have a central recess for receiving the mounting element 24 and a fastener for securing the mounting element 24 in place within the connector. Thus, where a connector is used, the mounting element 24 is secured above the top surface of the cabinet 20.

FIG. 4A illustrates the hardpoints 30*a*, 30*b*, 30*c* horizontally centered across the middle of the machine. The hardpoints 30*a*, 30*b*, 30*c*, however, can also be located closer to the front 32 and/or rear 34 of the machine as need be. In addition, although FIG. 4A specifically shows three discrete hardpoints 30*a*, 30*b*, 30*c*, embodiments of the subject invention can include more or less hardpoints without departing from the novel scope of the subject invention. The discrete mounting hardpoints 30*a*, 30*b*, 30*c* can additionally exhibit more intricate patterns, including for instance: a 3×3 matrix (nine hardpoints); a square (four hardpoints—each, for example, being near a corner); a cross (five hardpoints—three as shown in FIG. 4A with two additional hardpoints on either side in the middle positions), or arcuate or circular configurations without limitation.

FIG. 4B illustrates an exemplary adjustable slotted hardpoint 30*d* having an 'X' shaped configuration that can provide for varying the mounting position of a mounting element 24. The slotted hardpoint 30*d* can be a pre-drilled channel that is recessed into the top of a gaming machine cabinet 20 or into a mounting adaptor plate 28 that can be secured to the cabinet 20. The slot 36 of hardpoint 30*d* can be sized for receiving a correspondingly sized mounting element 24 and can include a fastener or fastening device 38 for releaseably securing the mounting element 24 in a specific position within the slot 36. Thus, a mounting element 24 can be positioned at any location within the slot 36, which can provide for more variation or adjustment of a display 14 relative to the front 32 or rear 34 of a gaming machine 16 and/or across the width of the machine. Although FIG. 4B, specifically shows a single slotted hardpoint 30*d* having an 'X' shaped configuration, persons of ordinary skill in the art will understand that embodiments presented herein can provide for a plurality of separate slotted hardpoints and/or slotted hardpoints having any number of alternate shapes without departing from the novel scope of the subject invention.

Referring back to FIGS. 1-3 in view of the mounting configurations described above, it will be recognized that FIG. 1 illustrates two side-by-side gaming machines 16*a*, 16*b* supporting a single overhead display 14 with the mounting elements 24 secured to the "outer" hardpoints of each of the machines. For example, where the machines 16*a*, 16*b* feature the mounting configuration shown in FIG. 1, the mounting element 24 secured to machine 16*a* would be coupled to hardpoint 30*a*, whereas the mounting element 24 secured to machine 16*b* would be coupled to hardpoint 30*c*. In this configuration, the distance between the hardpoints 30*a* on machine 16*a* and hardpoint 30*c* on an adjacent machine 16*b* can be configured to match the distance between mounting elements 24 for a standard sized display apparatus 14 (such as for example a 55" video display).

FIG. 2 illustrates the same type of mounting configuration as illustrated in FIG. 1, but in connection with adjacent pairs of gaming machines placed side-by-side. FIG. 2 thus illustrates how embodiments presented herein can provide for a standardized display arrangement across a bank of gaming machines. It will be recognized that such display arrangement provides a more refined and desirable aesthetic improvement over prior display configurations.

FIGS. 1A, 2A, 2B and 3 and illustrate an alternative staggered mounting arrangement where support members 24 are secured to hardpoints in different locations on different machines. For example, FIG. 3 shows an arrangement 12 featuring three gaming machines 16*a-c*. Where the machines 16*a-c* include the hardpoint arrangement illustrated in FIG. 4A, it will be recognized that the mounting elements 24 for the display 14 can be affixed to hardpoint 30*c* of machine 16*a* and to hardpoint 30*a* of machine 16*c*.

Figure 5:
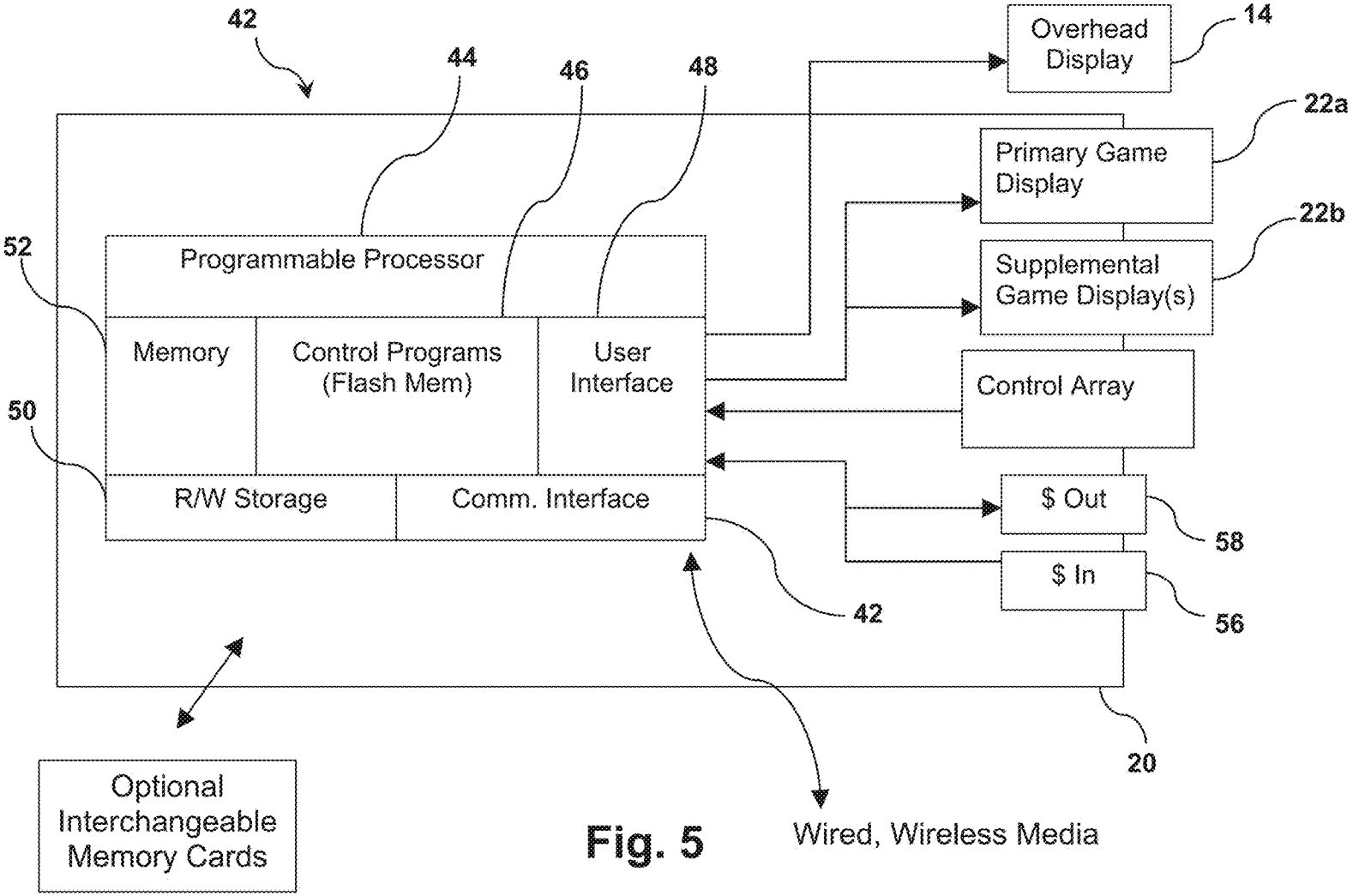
FIG. 5 is a block diagram of a gaming machine in accordance herewith.
Figure 6:
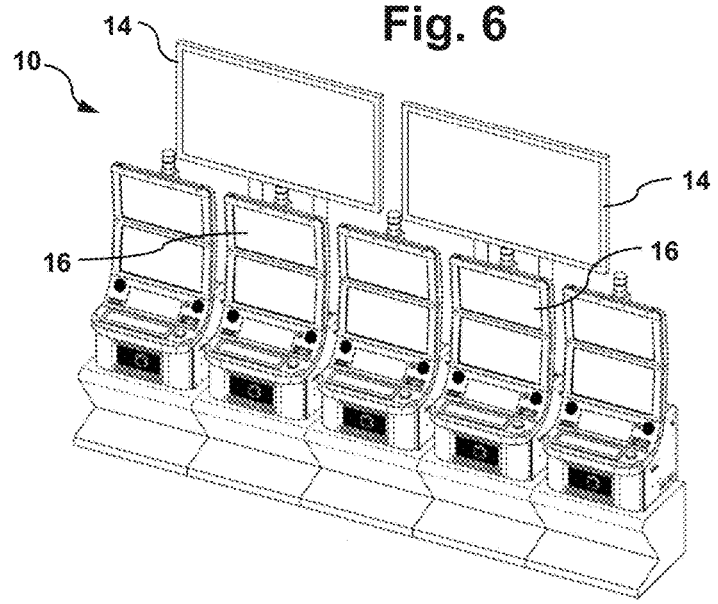
FIG. 6 is a perspective view of a single row of five gaming machines arranged side-by-side with two overhead displays mounted thereto in accordance with embodiments presented herein.
Figure 7:
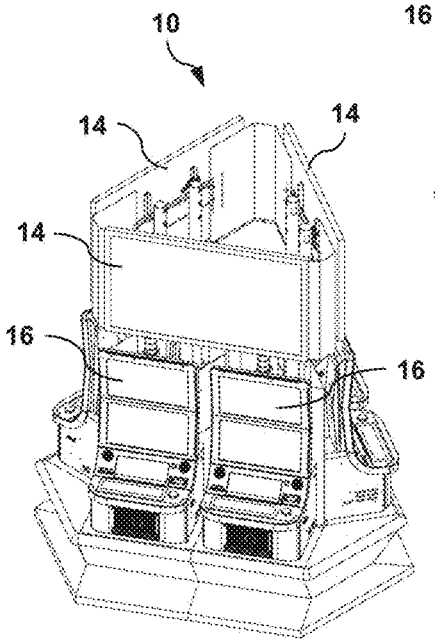
FIG. 7 is a perspective view of an arrangement of six gaming machines arranged in a triangle configuration with three overhead displays mounted thereto in accordance with embodiments presented herein.

FIG. 5 is a block diagram illustrating an electronic gaming machine ("EGM") 42 of the type that can be incorporated into embodiments of the subject invention. The EGM 42 can include a programmable processor 44 (such as for example a microprocessor or microcontroller) operatively coupled to one or more game displays 22*a*, 22*b*. The processor 44 can include control programs 46 and associated circuitry and be operatively connected to a user interface 48 with input/output circuits and at least one storage unit 50 which can store a plurality of instructions executable by the processor 44. The processor 44 can also include memory 52 which can include a main memory containing dynamic information processed by the processor 44 during operation, and/or a static memory which contains fixed information, such as, for example, an operating system, game programs, and a configuration of information necessary for the processor 44 to register and execute input from a player through a control array 54.

As described above, the displays 22*a*, 22*b* can include any kind of electronic display device suitable for visually presenting dynamic video images or representations of a game played on the EGM 40. The displays 22*a*, 22*b* can be CRT, LCD, plasma or LED display devices or monitors and can be physically enclosed in the same housing or cabinet 20 as the processor 44 or can be a located outside the cabinet 20 and be operatively coupled to the processor 44. The displays 22*a*, 22*b* can additionally include touch screen capabilities for receiving input from a player.

The processor 44 can execute the control programs 46 to perform primary functions for play the game, such as for example, randomly selecting game outcomes from a plurality of possible outcomes, recognizing a particular outcome as a predetermined winning or non-winning outcome and/or determining a reward amount associated with a particular winning outcome. The processor 44 can additionally control the game displays 22*a*, 22*b* by generating static or dynamic video for presentation thereon.

In addition, where allowed by regulation, the EGM 44 can additionally be electrically connected to a display 14 of the type shown in FIGS. 1-3. According to such embodiments, the processor 44 and control programs 46 can additionally include applications and/or instructions stored on a computer readable medium for controlling the display 14 by electronically transmitting signals including data, images or video content for presentation on the display 14. The presentation of images or other information on the display 14 can be in response to certain predetermined events or conditions that occur in connection with a game played on the EGM 42 or other programmed events or criteria.

The control array 54 can include one or more input devices, such as for example, a keyboard, mechanical lever, a touch-screen, push buttons or pads and/or any other means for control, or desired combination of controls, able to accept input from a player and produce output to the game display 22*a*, 22*b* in response to a player's input. Where embodiments of the subject invention are practiced or provided in connection with a wagering game, the gaming machine 42 can further include a credit input device 56, such as for example a coin or bill acceptor or card reader and a payout device 58. The credit input device 56 and payout device 58 can be operatively connected to the processor 44 and when money or other credits are deposited in connection with a game, the control program 46 can instruct the payout device to issue an award in response to the selection of certain predetermined winning outcomes of the game. The reward or payoff can be provided in any form, including for example, coins, bills, credits, points, cards, tickets or coupons.

The gaming machine 42 can additionally feature communication means for electrically transmitting signals, including control signals, game data or detected conditions to a remote electronic device such as for example, a computer, network or display device, dedicated storage device, or other mobile electronic device such as a PDA, smart phone, notebook computer or electronic tablet. Such communication means can include a communication interface 60 that can connect the EGM to external electronic devices via wired or wireless communication.

As will be understood by those of ordinary skill in the art, while the description above details the preferred and best mode(s) of practicing the invention, many other configurations and variations are possible. For example, the invention need not be practiced with a commercial/regulated gaming system, but could be used with a variety of coin-operated amusement devices, home gaming systems, or any other appropriate system. Accordingly, the scope of the invention should be determined not by the embodiment(s) illustrated, but by the claims below and their equivalents.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be added to, or removed from the described embodiments.

What is claimed is:

1. A system for mounting an electronic display device above a plurality of gaming machines arrangeable in a plurality of different geometric configurations, comprising:

an electronic display device having a display screen for electronically presenting visual imagery thereon;

a mounting apparatus securable to the electronic display device, the mounting apparatus having a plurality of spaced apart elongated support members, the plurality of support members being removably securable to mounting points on a cabinet of at least one of the plurality of gaming machines, when secured to the electronic display device and cabinet, the support members extending downward from the display device to the mounting points such that the display device is supported in an overhead position above at least some of the plurality of gaming machines, and the electronic display and mounting apparatus having a plurality of different mounting arrangements for accommodating different geometric arrangements of the plurality of gaming machines, the plurality of mounting arrangements comprising a first arrangement where the spaced apart elongated support members are securable to mounting points on a cabinet of a single gaming machine of the plurality of gaming machines and a second arrangement where the spaced apart elongated support members are securable to mounting points on cabinets of multiple different gaming machines of the plurality of gaming machines, conversion between the plurality of mounting arrangements being achievable without removal of the mounting apparatus from the display device or adjustment of spacing between the elongated support members.

2. The system of claim 1 where the visual imagery presented on the display screen is implemented independent from operations performed on the plurality of gaming machines, the electronic display device being structurally supported by a cabinet of the plurality of electronic gaming machines but not operationally attached to the plurality of gaming machines.

3. The system of claim 1 where the mounting points are fixed, the mounting points being in substantially identical locations on cabinets of each gaming machine of the plurality of gaming machines.

4. The system of claim 3 where the mounting points comprise pre-drilled holes, the holes of one mounting point being sized to receive fastening devices to secure one of the plurality of elongated support members in a substantially upright position.

5. The system of claim 1 further comprising at least one gaming machine of the plurality of gaming machines.

6. The system of claim 1 where the display screen is in a substantially upright position when the electronic display device is supported in the overhead position, the visual imagery presented on the display screen being viewable at least from locations in front of a cabinet supporting the display device.

7. The system of claim 1 where the second mounting arrangement comprises the electronic display device being supported by two elongated support members, a first of the two elongated support members being mounted to a cabinet of a first gaming machine of the plurality of gaming machines and a second of the two elongated support members being mounted to a cabinet of a second different gaming machine of the plurality of gaming machines, the first and second gaming machines being substantially adjacent one another in a side-by-side configuration, the electronic display device being substantially centered above the first and second gaming machines.

8. The system of claim 1 where the first mounting arrangement comprises the electronic display device being supported by first and second elongated support members, the first and second support members both being mounted to a same cabinet of a first gaming machine of the plurality of gaming machines, the first gaming machine being flanked on each side by second and a third gaming machines of the plurality of gaming machines, the electronic display device being substantially centered above the first, second and third gaming machines.

9. The system of claim 1 comprising at least two electronic display devices, each electronic display device being supported by two elongated support members.

10. The system of claim 9 wherein the at least two electronic display devices are in substantially horizontal alignment.

11. A system for mounting an electronic display device above a plurality of gaming machines arrangable in a plurality of different geometric configurations, comprising:

an electronic display device having a display screen for electronically presenting visual imagery thereon;

a mounting apparatus securable to the electronic display device, the mounting apparatus having two spaced apart elongated support members, the two support members being removably securable to separate mounting points on a cabinet of at least one of the plurality of gaming machines, when secured to the electronic display device and cabinet, the support members extending downward from the display device to the mounting points such that the display device is supported in an overhead position above at least some of the plurality of gaming machines;

the electronic display and mounting apparatus having a plurality of different mounting arrangements for accommodating different geometric arrangements of the plurality of gaming machines, the geometric arrangements comprising a first geometric arrangement comprising first and second gaming machines adjacent one another in a side-by-side configuration and a second geometric arrangement comprising three gaming machines adjacent one another in a side-by-side configuration, conversion between the plurality of different mounting arrangements being achievable without removal of the mounting apparatus from the display device or adjustment of spacing between the elongated support members, in the first geometric arrangement, a first of the two elongated support members being secured to a cabinet of the first gaming machine and a second of the two elongated support members being secured to a cabinet of the second machine, the electronic display device being substantially centered above the first and second gaming machines, and in the second geometric arrangement, the two elongated support members being secured to the same cabinet of a first gaming machine of the three gaming machines, the first gaming machine being flanked on each side by second and a third gaming machines of the three gaming machines, the electronic display device being substantially centered above the first, second and third gaming machines.

12. The system of claim 11 where the visual imagery presented on the display screen is implemented independent from operations performed on the plurality of gaming machines, the electronic display device being structurally supported by a cabinet of the plurality of electronic gaming machines but not electronically attached to the plurality of gaming machines for coordinated operation with the plurality of gaming machines, the electronic display device operating independently from the plurality of gaming machines.

13. The system of claim 11 where the mounting points are fixed, the mounting points being in substantially identical locations on cabinets of each gaming machine of the plurality of gaming machines.

14. The system of claim 13 where the mounting points comprise pre-drilled holes, the holes of one mounting point being sized to receive fastening devices to secure one of the plurality of elongated support members in a substantially upright position.

15. The system of claim 11 further comprising at least one gaming machine of the plurality of gaming machines.

16. The system of claim 11 where the display screen is in a substantially upright position when the electronic display device is supported in the overhead position, the visual imagery presented on the display screen being viewable at least from locations in front of a cabinet supporting the display device.

17. The system of claim 11 comprising at least two electronic display devices, each electronic display device being supported by two elongated support members.

18. The system of claim 17 wherein the at least two electronic display devices are in substantially horizontal alignment.

* * * * *